US009254407B2

(12) United States Patent
Savarino

(10) Patent No.: US 9,254,407 B2
(45) Date of Patent: Feb. 9, 2016

(54) ELASTIC TUBING TERMINATOR

(71) Applicant: Balanced Body, Inc., Sacramento, CA (US)

(72) Inventor: Christopher J. Savarino, Sacramento, CA (US)

(73) Assignee: BALANCED BODY, INC., Sacramento, CA (US)

( * ) Notice: Subject to any disclaimer, the term of this patent is extended or adjusted under 35 U.S.C. 154(b) by 294 days.

(21) Appl. No.: 13/801,829

(22) Filed: Mar. 13, 2013

(65) Prior Publication Data

US 2014/0270924 A1 Sep. 18, 2014

(51) Int. Cl.
*A63B 21/055* (2006.01)

(52) U.S. Cl.
CPC ..... *A63B 21/0557* (2013.01); *Y10T 403/54* (2015.01)

(58) Field of Classification Search
CPC ..... A63B 21/16; A63B 21/00043; A63B 21/0552; A63B 21/0557; Y10T 403/54
See application file for complete search history.

(56) References Cited

U.S. PATENT DOCUMENTS

| | | | | |
|---|---|---|---|---|
| 2,930,614 | A | 8/1954 | McIntosh | |
| 3,589,721 | A * | 6/1971 | Cronauer | 482/125 |
| 5,007,635 | A | 4/1991 | Tiller | |
| 5,250,016 | A | 10/1993 | Higgins | |
| 5,622,443 | A * | 4/1997 | Lampert et al. | 403/294 |
| 5,800,322 | A | 9/1998 | Block | |
| 6,348,026 | B1 * | 2/2002 | Kuo | 482/126 |
| 6,402,668 | B1 | 6/2002 | Harker | |
| 6,497,641 | B1 | 12/2002 | Hinds | |
| 6,979,286 | B1 | 12/2005 | Hinds | |
| 7,465,258 | B1 * | 12/2008 | Mortorano | 482/126 |
| 7,749,140 | B1 * | 7/2010 | Lindemeier et al. | 482/82 |
| 7,931,570 | B2 | 4/2011 | Hoffman | |
| 8,075,461 | B2 | 12/2011 | Terry et al. | |
| 8,591,386 | B2 * | 11/2013 | Meyer | 482/99 |
| 2006/0003629 | A1 * | 1/2006 | Murphy et al. | 439/578 |
| 2007/0015643 | A1 | 1/2007 | Kung | |
| 2007/0111869 | A1 * | 5/2007 | Wallach | 482/129 |
| 2008/0300117 | A1 | 12/2008 | Madden | |
| 2010/0167884 | A1 | 7/2010 | Kassel | |
| 2010/0317495 | A1 * | 12/2010 | DiGiovanni et al. | 482/129 |
| 2012/0202657 | A1 * | 8/2012 | Wang | 482/122 |
| 2013/0225371 | A1 * | 8/2013 | Harrer et al. | 482/8 |
| 2013/0316876 | A1 * | 11/2013 | Publicover et al. | 482/27 |

OTHER PUBLICATIONS

International Search Report and Written Opinion, dated Jun. 2, 2014, from corresponding, co-owned International Application No. PCT/US2014/018183.

* cited by examiner

*Primary Examiner* — Loan H Thanh
*Assistant Examiner* — Sundhara Ganesan
(74) *Attorney, Agent, or Firm* — Greenberg Traurig, LLP

(57) ABSTRACT

A tubing terminator is disclosed having two parts that are threaded together to receive and capture an expanded end portion of an elastic tube without exerting a compressive force against the expanded end portion of the tubing. The terminator has a C shaped handle and a threaded cap which together capture the end portion therebetween. A kit for terminating a free end of an elastic tubing resistance member includes a ball sized to be inserted into one end of an elastic tubing resistance member so as to expand the end of the elastic resistance member, a C shaped handle for receiving therein an expanded end of the elastic tubing resistance member, and a tubular cap removably fastenable to the handle to capture and retain the expanded end of the elastic tube in the handle.

3 Claims, 5 Drawing Sheets

ELASTIC TUBING TERMINATOR

BACKGROUND OF THE DISCLOSURE

1. Field of the Disclosure

The present disclosure relates to elastic tubing. In particular, it relates to an elastic tubing resistance member utilized in an exercise apparatus.

2. State of the Art

Resistance exercise devices that utilize a stretchable elastic band or bands e.g., elastic tubing, to provide the resistance require some kind of fastener or terminator at each end of the tubing. Typically the end of the tubing is captured at a pinched constriction as the end passes through a handle constriction. One exemplary terminator requires a plastic ball plug inserted into the end of the tube after the tube has been inserted through an opening in a handle or bracket. When the tubing is retracted partly back through the opening the plug stops further passage and prevents withdrawal of the tubing end from the opening. A substantial amount of stress is exerted by the handle or bracket on the tubing end at this restriction and hence wear occurs at this contact pinch point. Typically this is where failures of the elastic tubing tend to occur. Furthermore, when the tubing is relaxed and pushed further through the opening, the end with the plug tends to be pushed out of the handle or bracket. What is needed then is a terminator that minimizes wear due to the contact pinch and also precludes inadvertent withdrawal of the tubing end from the handle or bracket into which it is installed.

SUMMARY OF THE DISCLOSURE

A terminator for an end of an elastic tubing resistance member in accordance with the present disclosure includes a C shaped handle for receiving therein an expanded end portion of an elastic tubing resistance member and a tubular cap removably fastened to the handle to capture and retain the expanded end portion of the elastic tube in the handle. The terminator handle is preferably a solid body having a threaded end portion, a radial flange portion and an opposite tapered end portion. Each of the portions has a central axial bore and a common radial slot intersecting the central bore to form the generally C shape of the handle.

The terminator cap is a generally tubular body that has a top, a bottom, and a threaded side wall for mating with and engaging the threaded end portion of the handle. The top of the cap may be closed or may preferably be open. Preferably the open top has a pair of opposing radial flanges extending inward to prevent passage of the expanded end portion of an elastic tubing resistance member therethrough.

The central axial bore generally has a funnel shape. In particular, the central axial bore through the thread portion of the handle has a taper shape and the central axial bore through the tapered portion of the handle has a straight shape such that the expanded end portion of the tubular resistance member cannot enter the straight part of the central axial bore and is retained in the tapered part of the bore.

The flange portion of the handle may include one or more magnets spaced around the central bore. These magnets may be used to attract the handle to the steel of a slotted steel bracket through which the resistance member is inserted.

The terminator cap preferably has a top and a bottom. The bottom has a ring shape with teeth for engaging the flange portion of the handle when the cap is threaded onto the handle. The top of the cap may be closed or open to permit a portion of the tubing end to pass therethrough. However, if the top is open, the top preferably has at least one, or a pair of radial flanges extending inward to prevent an expanded end portion of the tubing to pass through the top.

A kit for replaceably terminating an end of an elastic tubing resistance member in accordance with the present disclosure includes a stopper ball sized to be inserted into the end of the elastic tubing resistance member so as to expand the end of the elastic resistance member, a C shaped handle for receiving therein an expanded end of the elastic tubing resistance member, and a tubular cap removably fastenable to the handle to capture and retain the expanded end of the elastic tubing resistance member in the handle.

BRIEF DESCRIPTION OF THE DRAWINGS

The disclosure will be better understood and objects, other than those set forth above, will become apparent when consideration is given to the following detailed description. Such description makes reference to the accompanying drawings wherein.

DETAILED DESCRIPTION

In the following description, numerous specific details are set forth in order to provide a more thorough disclosure. It will be apparent, however, to one skilled in the art, that the art disclosed may be practiced without these specific details. In some instances, well-known features may have not been described in detail so as not to obscure the art disclosed. In the several views, like numbers are used to identify like components and subcomponents where appropriate.

Figure 1:
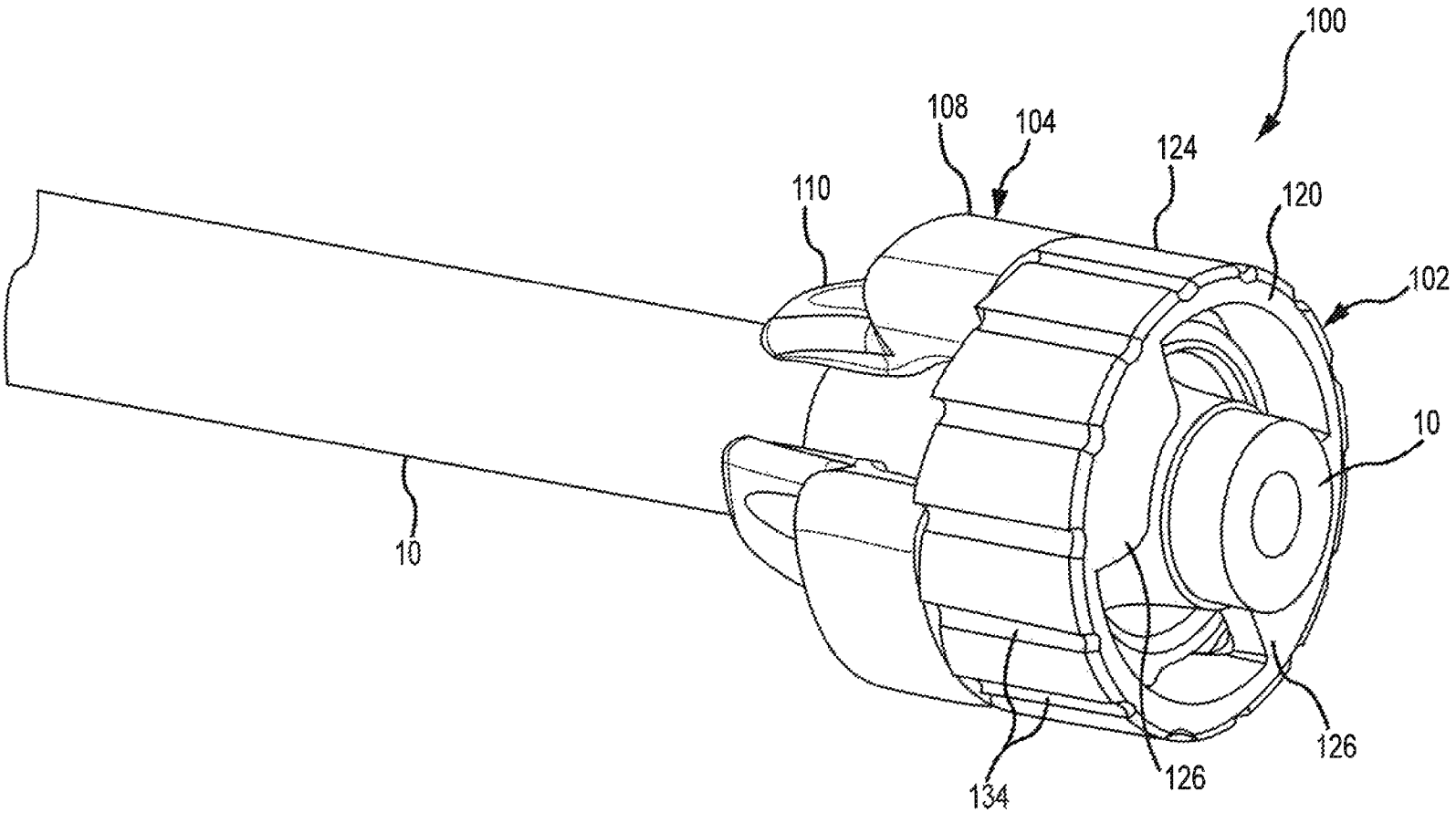
FIG. 1 is a perspective view of an embodiment of a tubing terminator in accordance with the present disclosure assembled on and fastened to one end of a tubular elastic resistance member.
Figure 2:
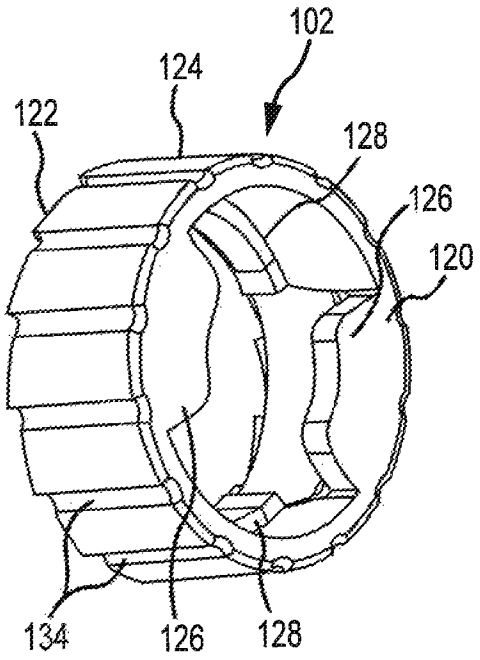
FIG. 2 is an exploded end perspective view of the tubing terminator in accordance with the present disclosure shown in FIG. 1.
Figure 2:
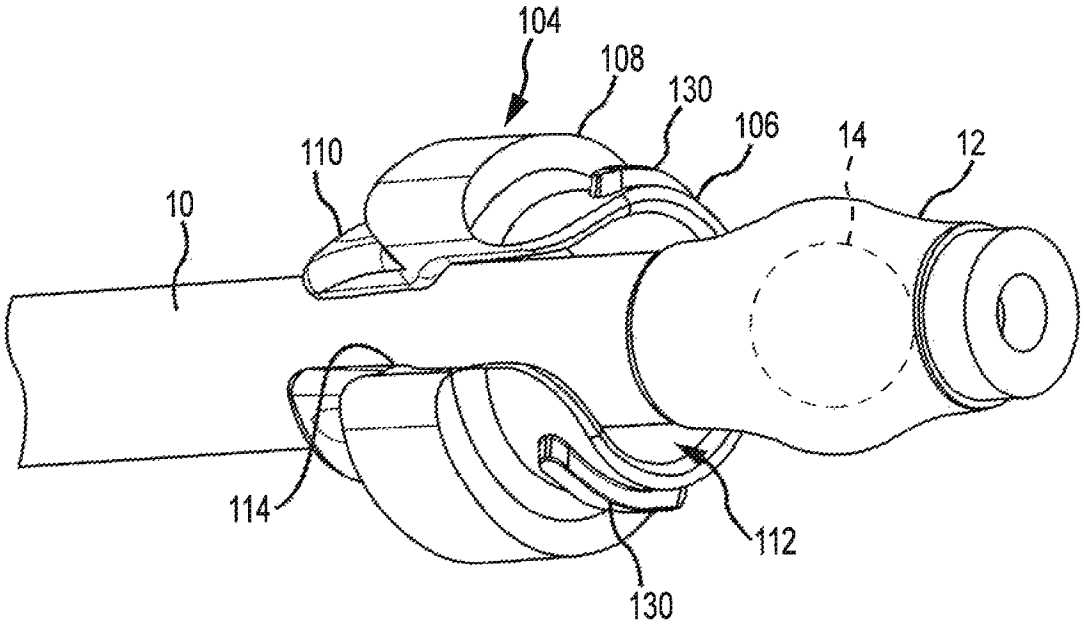

A perspective view of an assemble terminator assembly 100 on one end of an elastomeric tube 10 is shown in FIG. 1. An exploded view of the same terminator 100 is shown in FIG. 2. The terminator assembly 100 essentially includes a C shaped handle 104 for receiving an expanded end portion of the elastic tubing resistance member 10 and a cap 102.

The expanded end portion of the tubing 10 is preferably prepared by first inserting a plug 14 into the bore of the tubing 10 and then sliding an elastomeric sleeve 12 over the end of the tube 10 such that the plug 14 is centered within the sleeve 12. The plug 14 is preferable a spherical ball of plastic such as a nylon, or wood, or other hard material. However, other shapes such as a cylinder or tapered plug may alternatively be used in accordance with the present disclosure. The sleeve 12 is preferably made of the same material as the tubing 10, and is preferably used to minimize the frictional wear of the tubing 10 against the inner surfaces of the handle 10 during use. The tubing 10 and sleeve 12 preferably may both be made of an elastomer such as a rubber latex. Alternatively any elastomeric material may be utilized that has the desired elasticity and durability characteristics. Alternatively, the sleeve 12 could be made of a more abrasion resistant material than tubing 10 such as a thin nylon or mesh material.

The C shaped handle 104 is a solid, preferably molded polymer partial tubular body that has an externally threaded end portion 106, a radial flange portion 108, and a tapered end portion 110. Each of the portions 106, 108 and 110 has a central common axial bore 112 therethrough and a common radial slot 114 intersecting the central bore 112 to form the generally C shape of the handle 104 that is configured to wrap around the enlarged, preferably sleeved, end of the tubing 10. The common slot 114 is sized to permit a portion of the tubing 10 to be compressed slightly and then pushed into the central bore 112. The enlarged end of the tube 10 is then pulled into the handle 104 as is shown in FIG. 1, and the cap 102 threaded onto the end portion 106 to complete the assembly of the terminator 100.

Figure 3:
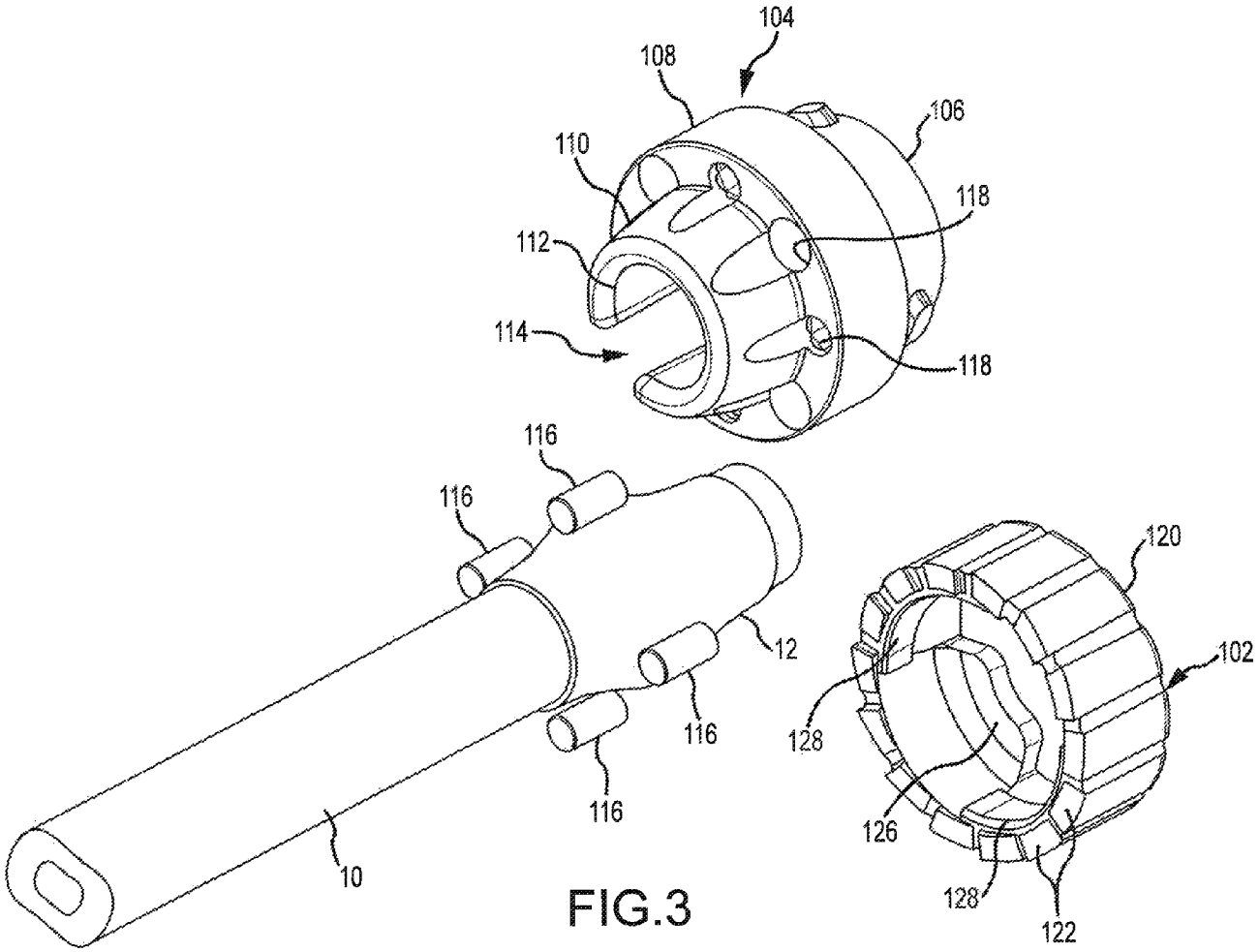
FIG. 3 is a rear exploded view of the tubing terminator shown in FIG. 2.

A rear perspective exploded view of the terminator 100 is shown in FIG. 3. The flange portion 108 has an outer diameter greater than the outer diameter of the tapered portion 110 and greater than the outer diameter of the threaded portion 106. In this view of FIG. 3, there are shown a set of four magnets 116 which are press fit within axially aligned bores 118 in the flange portion 108 spaced around the flange portion 108. When the terminator 100 in accordance with the present disclosure is mounted into a slot in an exercise equipment bracket made of steel (not shown), these magnets 116 can removably magnetically hold the terminator 100 in position in the bracket when the tubing 10 is not under tension. The tapered portion 106 of the body 104 is sized to help guide insertion of the terminator 100 into an appropriately sized slot in such a bracket such that the flange portion 108 stops further insertion of the terminator and the flange portion 108 can abut against the bracket face. The magnets 116 then tend to retain the body 104 in position.

The cap 102 is a generally tubular polymer body having a top end 120, a bottom end 122 and an internally threaded side wall 124. The top end 120 is preferably open to permit a portion of the tubing 10 to extend therethrough, and preferably has a pair of radially inwardly directed flanges or tabs 126 that prevent the enlarged end portion of the tubing 10 containing the plug 14 from passing out of the terminator 100. The side wall 124 has internal threads 128 that mate with and engage corresponding external threads 130 on the threaded portion 106 of the terminator body 104 when the cap 102 is installed on the threaded end portion 106 of the terminator body 104. The bottom end 122 of the cap 102 has a ring shape surface that engages the flange portion 108 of the terminator body 104 when the two are mated. This bottom end 122 preferably has a set of saw teeth 132 that engage the flange portion 108 to inhibit disconnection of the cap 102 from the body 104. The outer surface of the side wall 124 of the cap 102 is preferably knurled or configured with axial grooves 134 to aid a user in grasping the cap 102 to fasten and unfasten the cap 102 to the handle 104.

Figure 4:
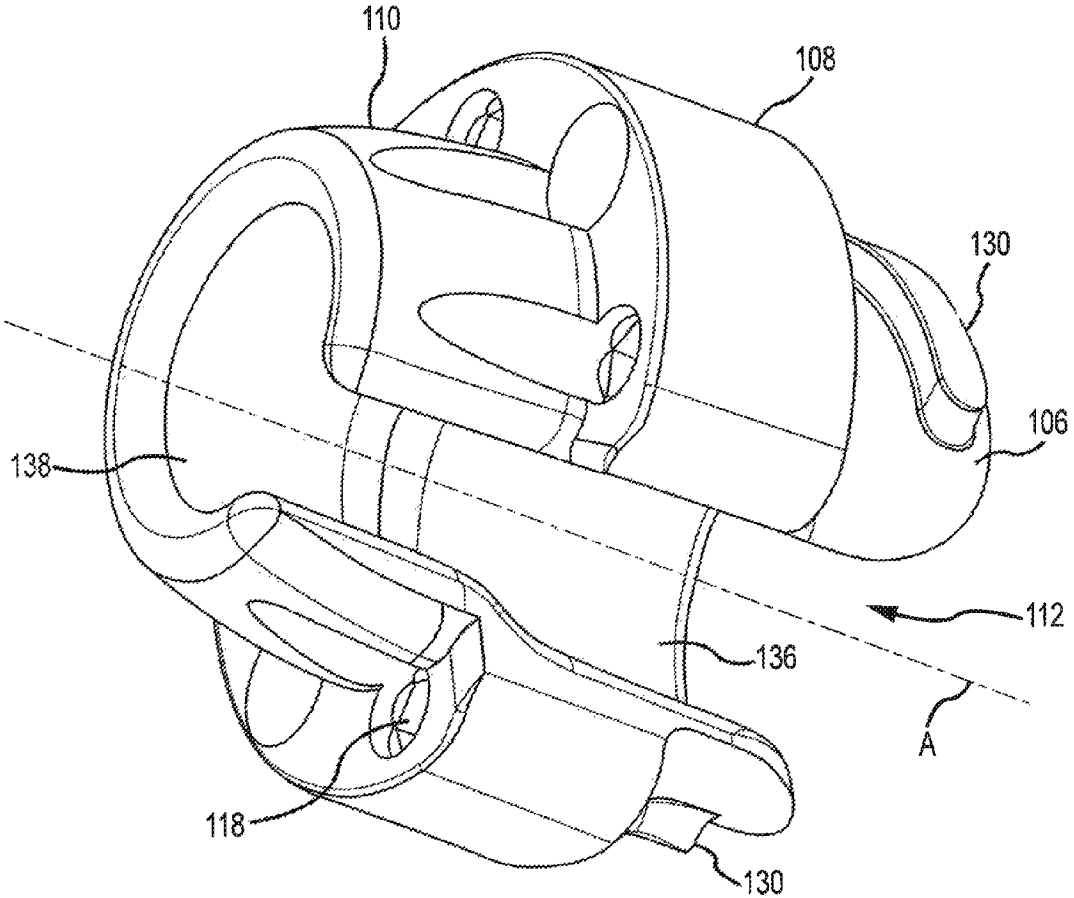
FIG. 4 is a separate perspective view of the handle of the terminator shown in FIGS. 1-3.
Figure 5:
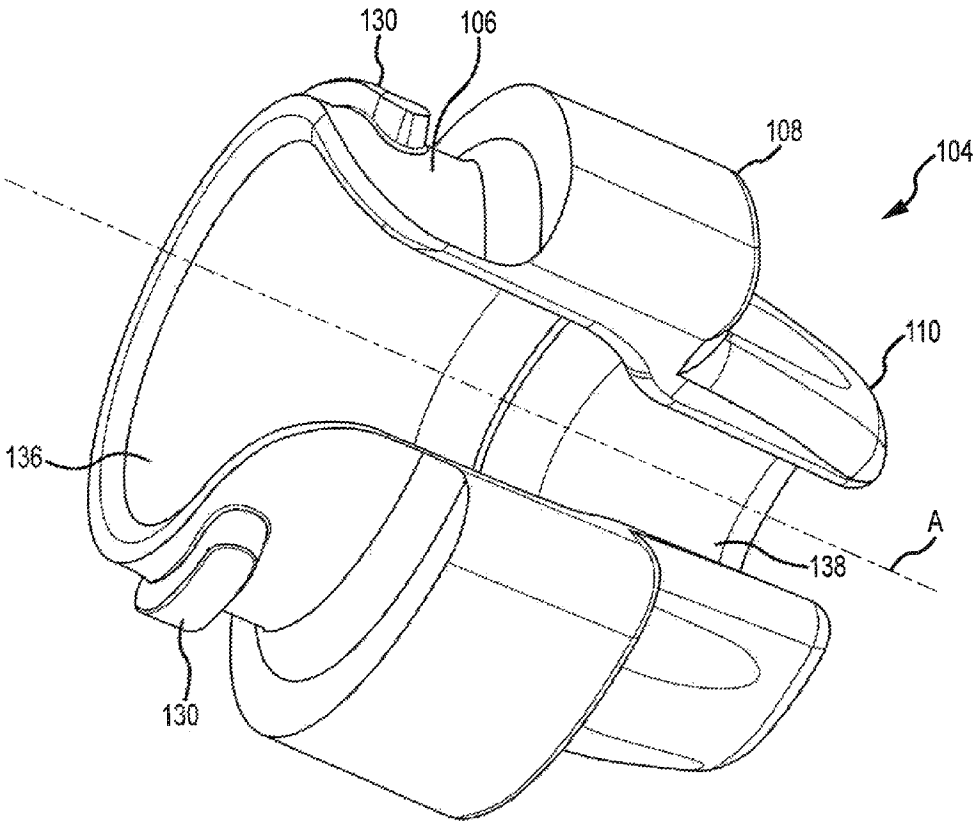
FIG. 5 is another separate perspective view of the handle of the terminator shown in FIG. 4.

Separate perspective views of the handle body 104 are shown in FIGS. 4 and 5. The central axial bore 112 is symmetrical about axis A through the body 104 and has a funnel shape with a generally tapered portion 136 through the threaded portion 106 and part of the flange portion 108. This tapered portion 136 narrows to a straight portion 138 in the tapered portion 110 of the handle 104. The sizing of the funnel shape of the bore 112 is generally chosen to be complementary to the outer contour of the enlarged end of the sleeved tubing 10/12 with the stopper ball 14 installed. This is done so that the contact between the enlarged end portion of tube 10 and the internal surface of the handle body 104 is preferably spread out over as large a surface area as possible so as to minimize stress concentrations on the tube 10 when the tubing 10 is in tension during use. The tapered internal portion 136 of the threaded portion 106 also permits the enlarged end of the tube 10 to protrude from the handle 104 whenever the tube 10 is not under tension. The cap 102 prevents the tube 10 from extending too far out of the handle 104 by engaging the tabs 126 with the enlarged end of the tube 10. Thus the assembled handle 104/cap 102 of the terminator 100 preferably loosely captures the enlarged end of the tube 10 when the tube 10 is not under tension. This arrangement greatly decreases wear on the elastic tube 10 over time. Alternatively, the terminator 100 could be sized to grasp or compress the enlarged end of the tube 10 rather than loosely capture the enlarged end. However, a loose capture is preferred.

A kit for replaceably terminating one end of an elastic band assembly for an exercise apparatus that utilizes a plurality of conventional elastic band assemblies with fixed terminators with replaceable assemblies such as have been described herein includes a handle assembly 100, preferably a wear sleeve 12 and a ball 14 sized to be inserted into the end of the elastic tubing resistance member 10 so as to expand the end of the elastic resistance member 10. The handle assembly 100 of the kit preferably may include a C shaped handle 104 for receiving therein an expanded end of the elastic tubing resistance member 10, and a tubular cap 102 removably fastenable to the handle 104 to capture and retain the expanded end of the elastic tube 10 in the handle assembly 100.

A kit for replacing a broken elastic resistance member 10 in an elastic band assembly that already includes a pair of terminators 100 in accordance with the present disclosure includes a preassembled tubing resistance member 10 with balls 14 and sleeves 12 preinstalled at the ends of the resistance member 10 as above described. A user would simply remove the caps 102 from each of the terminator handles 104, remove the broken tubing ends, and insert the new tubing 10 ends into the terminator handles 104, place one of the caps 102 onto one of the handles 104, and rotate the cap 102 clockwise to secure the cap onto the handle 104. The process is repeated for the other handle 104 at the other end of the new resistance member 10 to complete the elastic band assembly.

Various modifications may be made to the tubing terminator described above. For example, the tapered portion 136 may be a straight taper or may have a curved shape complementary to that of the plug 14. For example, a partial spherical surface complementary to a spherical ball plug shape 14 as is shown in FIGS. 2 and 4. Furthermore, the cap 102 may have a closed, i.e. solid, top end 120 rather than an open end with flanges 126. Alternately, top end 120 could be closed, with a central hole therethrough. These are only exemplary variations. Other modifications will be readily apparent to one skilled in the art. Accordingly, all such alternatives, variations and modifications are intended to be encompassed within the scope of and as defined by the following claims.

What is claimed is:

1. A kit for replaceably terminating an end of an elastic tubing resistance member comprising:

a stopper sized to be inserted into one end of an elastic tubing resistance member having a first outer diameter so as to produce an expanded end of the elastic resistance member having a second outer diameter greater than the first outer diameter; and a handle having a C shape around a central axial bore through the handle and a radial open slot extending into the central axial bore for receiving and holding therein the expanded end of the elastic tubing resistance member, the handle having an outwardly flanged portion and an externally inwardly tapered front end portion, wherein the slot extends through the front end portion and the flanged portion and the slot is tapered toward the front end portion.

2. The kit according to claim 1 wherein the flanged portion of the handle is sized to accommodate the expanded end of the elastic resistance member and the slot has a width less than the first outer diameter such that the elastic tubing resistance member must be compressed to pass laterally through the slot into the central axial bore.

3. The kit according to claim 2 further comprising a tubular cap axially fastenable to a threaded rear end portion of the handle.

* * * * *